US005868006A

United States Patent [19]

Kandala

[11] Patent Number: 5,868,006

[45] Date of Patent: Feb. 9, 1999

[54] AIR SEPARATION METHOD AND APPARATUS FOR PRODUCING NITROGEN

[75] Inventor: Vara P. Kandala, Edison, N.J.

[73] Assignee: The BOC Group, Inc., New Providence, N.J.

[21] Appl. No.: 961,579

[22] Filed: Oct. 31, 1997

[51] Int. Cl.[6] ..... F25J 3/00

[52] U.S. Cl. ..... 62/652; 62/901

[58] Field of Search ..... 62/643, 652, 901

[56] References Cited

U.S. PATENT DOCUMENTS 4,617,037 10/1986 Okada et al. ..... 62/652
5,325,674 7/1994 Gastinne et al. ..... 62/901
5,582,034 12/1996 Naumovitz ..... 62/652

*Primary Examiner*—Ronald Capossela
*Attorney, Agent, or Firm*—David M. Rosenblum; Salvatore P. Pace

[57] ABSTRACT

A method and apparatus for producing nitrogen within a nitrogen generator in which coolant streams composed of column bottoms and liquid having a nitrogen content greater than column bottoms are withdrawn from the column and then used to condense tower overhead for reflux purposes. The liquid composed of the oxygen-rich liquid after vaporization is expanded in a turboexpander with a performance of work. The other coolant stream is recompressed, cooled and then used to produce boil-up in the bottom of the column in order to produce the liquid vapor ratio in the bottom of the column.

8 Claims, 1 Drawing Sheet

AIR SEPARATION METHOD AND APPARATUS FOR PRODUCING NITROGEN

BACKGROUND OF THE INVENTION

The present invention relates to an apparatus and method for producing nitrogen in which air is rectified within a single column to produce a nitrogen rich tower overhead. More particularly, the present invention relates to such a method and apparatus in which reflux for the column is produced in a head condenser utilizing a coolant stream composed of a nitrogen containing liquid having a nitrogen content greater than that of oxygen-rich liquid produced as column bottoms within the column. Still even more particularly, the present invention relates to such an apparatus and method in which the coolant is recompressed and then liquefied within a reboiler contained within the bottom of the column prior to its reintroduction into the column.

Nitrogen is produced in a single column plant known as a nitrogen generator. In such a plant, air is compressed, purified, and cooled to a temperature suitable for its rectification, normally, at or near dewpoint temperature of the air. The air is then introduced into the column and rectified to produce a nitrogen rich tower overhead and an oxygen rich column bottoms. The column can be designed with a sufficient number of stages to produce high purity and even ultra-high purity nitrogen as a product.

An example of such a single column nitrogen generator is shown in U.S. Pat. No. 5,582,034. In this patent, coolant for the column head condenser consists of two streams, one of which is composed of the oxygen-rich column bottoms and the other of which is composed of a nitrogen containing liquid having a higher nitrogen content than the oxygen-rich column bottoms. The nitrogen containing liquid after having been vaporized is recompressed and then reintroduced into the bottom of the column. The coolant stream composed of the oxygen-rich liquid is partially warmed and then expanded within a turbo expander to produce refrigeration for the plant.

The re-introduction of the coolant, composed of the nitrogen containing liquid, increases recovery of the nitrogen product. However, since the nitrogen containing liquid has a higher nitrogen content than the oxygen-rich liquid, it has a higher dewpoint pressure for the same temperature of the oxygen-rich liquid. In other nitrogen generators it is the oxygen-rich liquid that solely serves as the coolant and is reintroduced into the column to increase recovery. However, when the nitrogen containing liquid is used for this purpose, since it has the higher dewpoint pressure, the required compression is lower for the same amount of production, and therefore there are efficiencies of operation that are realized in this patent.

As will be discussed, however, the apparatus and process of U.S. Pat. No. 5,582,034 can be further modified to produce similar nitrogen recoveries.

SUMMARY OF THE INVENTION

The present invention provides a method of producing nitrogen in which compressed and purified feed air is cooled to a temperature suitable for its rectification. The compressed, feed air is then introduced into a distillation column to produce a nitrogen rich vapor tower overhead and an oxygen-rich liquid as column bottoms. At least part of a nitrogen rich stream, composed of the nitrogen rich vapor tower overhead, is condensed. At least part of the resulting condensate is introduced into the distillation column as reflux. A nitrogen containing liquid is extracted from the distillation column. The nitrogen containing liquid has a nitrogen content greater than that of the oxygen-rich liquid. First and second coolant streams composed of the oxygen-rich liquid and the nitrogen containing liquid are expanded. The first and second coolant streams are used to condense the at least part of the nitrogen rich stream. In so doing, the first and second coolant streams form vaporized first and second coolant streams. A nitrogen product is extracted from another part of the nitrogen rich stream.

The first vaporized coolant stream is partially warmed and then expanded with the performance of work to form a refrigerant stream. Heat is indirectly exchanged between the refrigerant stream and the compressed and purified air. The second vaporized coolant stream is compressed and then cooled. After cooling, the second vaporized coolant stream is liquefied against vaporizing part of the column bottoms to produce a liquid stream. The liquid stream is then introduced back into the distillation column.

In another aspect, the present invention provides an apparatus for producing nitrogen. The apparatus includes a main heat exchanger to cool compressed and purified feed air to a temperature suitable for its rectification. The main heat exchanger also is configured to partially warm a first vaporized coolant stream, to fully cool a second vaporized coolant stream to the temperature of rectification and, also, to indirectly transfer heat from the compressed purified air stream to a refrigerant stream. The distillation column is connected to the main heat exchanger to receive the compressed, purified feed air and thereby to produce a nitrogen rich tower overhead and an oxygen rich liquid as column bottoms.

A head condenser is connected to the distillation column and is configured to condense at least part of a nitrogen-rich stream composed of the nitrogen-rich tower overhead and to introduce at least part of the resulting condensate into distillation column as reflux against vaporizing first and second coolant streams, thereby to form to the first and second vaporized coolant streams. The head condenser is connected to the distillation column so that the first coolant stream is composed of the oxygen-rich liquid and the second coolant stream is composed of a nitrogen containing liquid having a nitrogen content between those of the oxygen-rich liquid and the air. The condenser is also connected to the main heat exchange means so that the first vaporized coolant stream partially warms therewithin. First and second expansion valves are interposed between the condenser and the distillation column for valve expanding the first and second coolant streams, respectively. A junction is interposed between the head condenser and the distillation column for producing a nitrogen product stream from another part of the nitrogen rich stream. An expansion means is connected to the main heat exchanger for expanding the first vaporized coolant stream with the performance of work to form the refrigerant stream. The main heat exchanger is connected to the expansion means so that the compressed and purified air indirectly exchanges heat to the refrigerant stream. A compressor is connected to the head condenser means for condensing the second vaporized coolant stream. The compressor is also connected to the main heat exchanger so that the second vaporized coolant stream cools therewithin. A reboiler is associated with the bottom region of the distillation column and is connected to the main heat exchanger for receiving the second vaporized coolant stream, thereby to liquefy the second vaporized coolant stream to form a liquid stream against vaporizing part of the column bottoms. The reboiler is connected to the distillation column so that the liquid stream is introduced back into the distillation column.

As stated above, the use of the first and second coolant streams reduces the energy involved in recompressing the first coolant stream. By liquefying the first coolant stream to form reboil within the column and then re-introducing the liquid into the bottom region of the column, the apparatus and method of the present invention would operate at a different relfux ratio, below the point of introduction, than prior art methodology such as disclosed in U.S. Pat. No. 5,582,034. Thus, the present invention represents an alternative route to achieving the nitrogen recoveries disclosed with such patent.

BRIEF DESCRIPTION OF THE DRAWINGS

While the specification concludes with claims distinctly pointing out the subject matter that Applicant regards as his invention, it is believed that he invention will be better understood when taken in connection with the accompanying drawings in which the sole FIGURE is an apparatus for carrying a method in accordance with the present invention.

DETAILED DESCRIPTION

Figure 1:
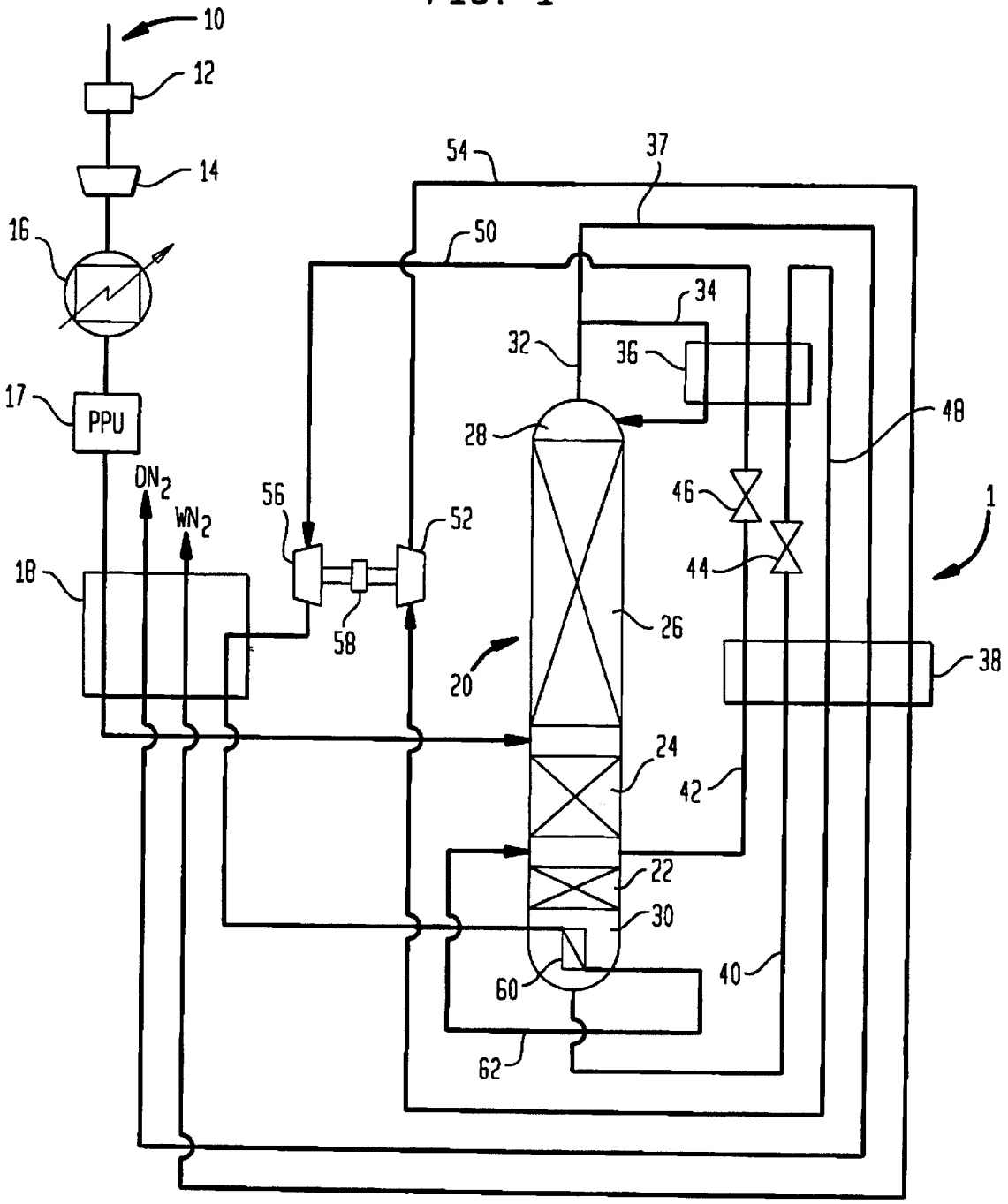

The FIGURE illustrates an apparatus 1 or carrying out a method in accordance with the present invention. In apparatus 1, a feed air stream 10, after having been filtered by a filter 12 is compressed by a compressor 14. After the heat of compression is removed by an after cooler 16, the compressed air is then purified within a pre-purification unit 17. Prepurification unit 17, as would be known in the art, consists of adsorption beds operating out of phase to remove moisture, carbon dioxide, hydrocarbons and other contaminants from the air.

Air stream 10 after having been compressed and purified is cooled to a temperature suitable for its rectification within a main heat exchanger 16. Although illustrated as a single unit, as would be appreciated by those skilled in the art, heat exchanger 16 could be a complex or a series of individual units interconnected together in a heat transfer relationship. The temperature suitable for the rectification of the air, as known is at or near a dewpoint of air contained within an air stream 10 after leaving main heat exchanger 18.

Air stream 10, as suitably cooled, is introduced into a distillation column 20 containing mass transfer elements 22, 24 and 26. Mass transfer elements, as known in the art, could be trays or packing, either structured or random that are designed to bring an ascending vapor phase of the mixture into connect with the descending liquid phase of the mixture. Such contact causes the vapor phase to ever more rich in the lighter components of the air to produce a nitrogen-rich vapor tower overhead within a top region 28 of distillation column 20. By the same token, the contacted liquid phase becomes ever more rich in the heavier components to produce an oxygen-rich liquid as column bottoms within a bottom region 30 of distillation column 20.

A nitrogen rich stream 32 is removed from the top region 28 of distillation column 20 and then divided into a reflux stream 34 and a product stream 37. Reflux stream 34 is condensed within a head condenser 36 and then reintroduced back into top region 28 of distillation column as reflux. This addition of reflux initiates formation of the descending liquid phase within distillation column 20. Product stream 37 after being partly warmed within a subcooling unit 38 is fully warmed within main heat exchanger 18 and discharged as product nitrogen labeled as "$PN_2$". As can be appreciated by those skilled in the art liquid products are possible by removal of part of the reflux stream 34 prior to its reintroduction to the column. Additionally, product stream 37 could be separately withdrawn to produce the product stream.

Nitrogen containing liquid is extracted from distillation column 20 from a location thereof at which the nitrogen containing liquid has a nitrogen content greater than that of the oxygen-rich liquid. Additionally, oxygen rich liquid is also extracted from the bottom region 30 of distillation column 20. The oxygen rich liquid and the nitrogen containing liquid are extracted as first and second coolant streams 40 and 42, respectfully. First and second coolant streams 40 and 42 are subcooled within subcooling unit 38 and are then valve expanded within expansion valves 44 and 46 to produce a sufficient temperature difference to condense reflux stream 34. The subcooling unit prevents any substantial vaporization of first and second coolant streams 40 and 42 prior to their serving condensing duty.

The condensing of reflux stream 34 causes first and second coolant streams 40 and 42 to vaporize and thereby form first and second vaporized coolant streams 48 and 50. First vaporized coolant stream 48 partially warms with subcooling unit 38 to help subcool first and second coolant streams 40 and 42 and then is expanded within a turboexpander 52 to produce a refrigerant stream 54. Refrigerant stream then partly warms within subcooling unit 38 to again help first and second coolant streams 40 and 42 to subcool and then passes through main heat exchanger 18 where it is discharged as waste nitrogen.

Second vaporized coolant stream 50 is compressed in a compressor 56 which can be coupled to turboexpander 52 by an energy dissipative brake 58. Energy dissipative brake 58 rejects heat energy from apparatus 1. As known in the art, energy dissipative brake 58 can be a coupling, electrical generator, and etc. Second vaporized coolant stream 50 is then fully cooled in main heat exchanger 18 and is then passed into a reboiler 60 which can either be a situated within or near bottom region of distillation column 20 as a separate unit. Heat exchange causes second vaporized coolant stream 50 to liquefy and thereby form a liquid stream 62 against vaporizing column bottoms within bottom region 30 of distillation column 20. Liquid stream 62 is then introduced into the location of distillation column 20 at which cooling stream 42 was withdrawn. This location is a few stages above bottom region of 30 of distillation column 20 (the stages provided by liquid-vapor contacting elements 22).

In the illustrated embodiment, product stream 37 can be of ultra-high purity and thus contain nitrogen having about 0.5 ppb of oxygen. Second coolant stream 42 and thus, liquid stream 62 on molar basis can contain about 35.5% oxygen, about 63.2% nitrogen, and about 1.3% argon. The liquid column bottoms and therefore first coolant stream 40 can have a content, on a molar basis, of about 44.5% oxygen, about 53.86% nitrogen, and about 1.6% argon.

While the present invention has been described with reference to preferred embodiment, as will occur to those skilled in the art, numerous changes, additions and omissions may be made without departing from the spirit and scope of the present invention.

I claim:

1. A method of producing nitrogen, said method comprising:

cooling compressed, purified feed air to a temperature suitable for its rectification;

introducing said compressed, purified feed air into a distillation column to produce a nitrogen rich vapor tower overhead and oxygen-rich liquid as column bottoms;

condensing at least part of a nitrogen-rich stream composed of said nitrogen-rich vapor tower overhead and introducing at least part of the resulting condensate into said distillation column as reflux;

extracting nitrogen containing liquid from said distillation column so that said nitrogen containing liquid has a nitrogen content greater than that of said oxygen-rich liquid;

expanding first and second coolant streams composed of said oxygen-rich liquid and said nitrogen containing liquid, respectively;

condensing said at least part of said nitrogen rich stream with said first and second coolant streams, thereby to form vaporized first and second coolant streams;

extracting a nitrogen product from another part of said nitrogen rich stream;

partially warming and expanding said first vaporized coolant stream with performance of work to form a refrigerant stream;

indirectly exchanging heat between said refrigerant stream and said compressed and purified air; and compressing said second vaporized coolant stream and cooling said second vaporized coolant stream;

liquefying said second vaporized coolant stream to produce a liquid stream against vaporizing part of the column bottoms; and introducing said liquid stream into said distillation column.

2. The method of claim 1, wherein said nitrogen product is extracted as a gaseous nitrogen product stream.

3. The method of claim 1, wherein said compressed and purified feed air is introduced into an intermediate location of said distillation column.

4. The method of claim 1 or claim 3, wherein said second vaporized coolant stream is compressed at essentially said temperature.

5. The method of claim 4, wherein said first and second coolant streams are subcooled prior to their being expanded.

6. The method of claim 5, wherein:

said nitrogen product is extracted as a gaseous nitrogen product stream; and said gaseous nitrogen product stream, said refrigerant stream, and said first vaporized coolant stream indirectly exchange heat with said first and second coolant streams, thereby to subcool said first and second coolant streams.

7. The method of claim 6, wherein said gaseous product nitrogen stream and said refrigerant stream fully warm, said first vaporized coolant stream partially warms through indirect heat exchange with said compressed, purified feed air and said second vaporized coolant stream.

8. An apparatus for producing nitrogen, said apparatus comprising:

a main heat exchanger configured to cool compressed, purified feed air to a temperature suitable for its rectification, to partially warming a first vaporized coolant stream, to fully cooling a second vaporized coolant stream to said temperature, and to indirectly transferring heat from said compressed, purified feed air to a refrigerant stream;

a distillation column connected to said main heat exchanger to receive said compressed, purified feed air, thereby to produce a nitrogen rich tower overhead and an oxygen-rich liquid as column bottoms;

a head condenser connected to said distillation column and configured to condense at least part of a nitrogen-rich stream composed of said nitrogen-rich tower overhead and to introduce at least part of the resulting condensate into said distillation column as reflux against vaporizing first and second coolant streams, thereby to form said first and second vaporized coolant streams;

said head condenser connected to said distillation column so that said first coolant stream is composed of said oxygen-rich liquid and said second coolant stream is composed of a nitrogen containing liquid having a nitrogen content between those of said oxygen-rich liquid and said air;

said head condenser also connected to said main heat exchange means so that said first vaporized coolant stream partially warms therewith;

first and second expansion valves interposed between said head condenser and said distillation column for valve expanding said first and second coolant streams, respectively;

a junction interposed between said head condenser and said distillation column for producing a nitrogen product stream from another part of said nitrogen rich stream;

expansion means connected to said main heat exchange means for expanding said first vaporized coolant stream with performance of work to form said refrigerant stream;

said main heat exchanger connected to said expansion means so that said compressed and purified air indirectly exchanges heat to said refrigerant stream; and a compressor connected to said condensing means for compressing said second vaporized coolant stream;

said compressor also connected to said main heat exchange means so that said second vaporized coolant stream cools therewithin; and a reboiler associated with a bottom region of said distillation column and connected to said main heat exchanger for receiving said second vaporized coolant stream, thereby to liquefy said second vaporized coolant stream to form a liquid stream and to vaporize part of the column bottoms;

the reboiler connected to said distillation column so that said liquid stream is introduced into said distillation column.

* * * * *